US012000142B2

(12) United States Patent
Gran et al.

(10) Patent No.: US 12,000,142 B2
(45) Date of Patent: Jun. 4, 2024

(54) BUILDING BLOCK, SYSTEM AND METHODS

(71) Applicant: Stone Strong LLC, Omaha, NE (US)

(72) Inventors: John J. Gran, Elkhorn, NE (US); Daniel J. Thiele, Omaha, NE (US)

(73) Assignee: Stone Strong LLC, Omaha, NE (US)

( * ) Notice: Subject to any disclaimer, the term of this patent is extended or adjusted under 35 U.S.C. 154(b) by 541 days.

(21) Appl. No.: 17/367,355

(22) Filed: Jul. 3, 2021

(65) Prior Publication Data

US 2023/0003017 A1 Jan. 5, 2023

(51) Int. Cl.

| | |
|---|---|
| ***E04B 2/46*** | (2006.01) |
| ***E02D 17/20*** | (2006.01) |
| ***E02D 29/02*** | (2006.01) |
| ***E04B 2/54*** | (2006.01) |
| ***E04C 1/39*** | (2006.01) |
| *E04B 2/02* | (2006.01) |

(52) U.S. Cl.

CPC ..... *E04B 2/46* (2013.01); *E02D 17/205* (2013.01); *E02D 29/025* (2013.01); *E02D 29/0266* (2013.01); *E04B 2/54* (2013.01); *E04C 1/39* (2013.01); *E04B 2002/0226* (2013.01); *E04B 2002/025* (2013.01); *E04B 2002/0258* (2013.01); *E04B 2002/0267* (2013.01)

(58) Field of Classification Search

CPC ..... E04B 2/46; E04B 2/54; E04B 2002/0226; E04B 2002/025; E04B 2002/0258; E04B 2002/0267; E02D 17/205; E02D 29/028; E02D 29/0266; E04C 1/39

See application file for complete search history.

(56) References Cited

U.S. PATENT DOCUMENTS

| | | | | | |
|---|---|---|---|---|---|
| 1,418,168 | A | | 5/1922 | Preston | |
| 4,041,670 | A | * | 8/1977 | Kaplan | E04B 2/18 52/592.2 |
| 4,123,881 | A | * | 11/1978 | Muse | E04B 2/44 52/439 |
| 4,393,018 | A | * | 7/1983 | Harbaugh | B28B 1/523 264/333 |
| 4,475,326 | A | | 10/1984 | Hanson | |
| 5,031,376 | A | * | 7/1991 | Bender | E02D 29/025 405/284 |
| 5,119,587 | A | * | 6/1992 | Waltz | A01G 9/28 47/33 |

(Continued)

*Primary Examiner* — Paola Agudelo

(74) *Attorney, Agent, or Firm* — Martin & Associates, LLC; Derek P. Martin

(57) ABSTRACT

Building blocks include a tongue and groove on each block that allow the blocks to be placed in a way that interlocks the tongue and groove of one block with the corresponding groove and tongue, respectively, of another block facing the opposite direction. In a first embodiment, the same building block that has a decorative front face is used for both sides of the wall, resulting in a wall with opposed finished surfaces. In a second embodiment, a first plurality of blocks that have a decorative front face are used for one side of the wall, while a second plurality of blocks that have a thicker and non-decorative face are used for the other side of the wall, with the first and second plurality of blocks interlocking back-to-back via their respective tongues and grooves. Both types of blocks can be made using the same concrete form.

22 Claims, 11 Drawing Sheets

(56) References Cited

U.S. PATENT DOCUMENTS 5,163,261 A 11/1992 O'Neill
5,233,806 A * 8/1993 Hightower ..... A01G 9/28 52/561
5,901,520 A 5/1999 Abdul-Baki
6,010,279 A 1/2000 Taylor-Smith
6,082,933 A * 7/2000 Maguire ..... E02D 29/025 52/592.6
6,178,715 B1 1/2001 Pacitto et al.
6,477,814 B1 11/2002 Kadosh
6,490,837 B1 * 12/2002 Dueck ..... E02D 29/025 52/603
6,701,687 B1 * 3/2004 Shillingburg ..... E02D 29/0241 52/600
6,796,098 B2 9/2004 Hampton
6,829,867 B2 12/2004 Gresser et al.
7,073,304 B2 7/2006 Hampton et al.
7,168,218 B2 * 1/2007 Spratlen ..... E04C 5/02 52/604
7,174,687 B2 2/2007 Ferguson
7,553,109 B2 * 6/2009 Blundell ..... E02D 29/0266 405/286
7,818,938 B2 10/2010 Lemieux
8,141,315 B1 3/2012 Shillingburg
9,021,762 B1 5/2015 DePalma
2002/0028114 A1 3/2002 Whitson
2003/0160147 A1 8/2003 Manthei
2003/0221386 A1 * 12/2003 McDonald ..... E04B 2/16 52/568
2005/0055944 A1 * 3/2005 Hampton ..... E02D 29/025 52/596
2005/0091940 A1 5/2005 Whitson
2005/0204663 A1 9/2005 Ferguson
2006/0150559 A1 * 7/2006 Haener ..... E04B 2/54 52/606
2008/0063480 A1 3/2008 Price et al.
2010/0043336 A1 * 2/2010 Jensen ..... E04B 2/44 52/604
2012/0311943 A1 * 12/2012 Gran ..... E04G 21/147 52/588.1
2013/0074436 A1 3/2013 Bott
2013/0255177 A1 * 10/2013 VonDross ..... B29C 39/10 264/274
2014/0059965 A1 * 3/2014 Edwards ..... E04B 2/16 52/588.1
2020/0270863 A1 * 8/2020 Pivac ..... E04C 1/00

* cited by examiner

BUILDING BLOCK, SYSTEM AND METHODS

BACKGROUND

1. Technical Field

This invention generally relates to construction materials and techniques, and more specifically relates to a building block wall system, methods of manufacturing blocks, and method that may be used to construct a wall.

2. Background Art

Building blocks have been used for centuries to construct homes, office buildings, churches, and many other structures. Early building blocks were hewn from stone into appropriate shapes that were assembled together, typically using mortar, to form a wall. In modern times, various types of concrete blocks have been developed, which are typically formed by pouring a cement-based concrete mixture into a form and allowing the concrete to cure. This type of concrete block is strong and makes for a sturdy wall, but installing a traditional concrete block requires a skilled mason that must manually lift each block, and set each block using mortar to secure the blocks in place. This process is very labor-intensive.

One application for concrete blocks is the construction of retaining walls. Retaining walls are required when there is a body of earth that needs to be held in place. While several different block designs have been used in the art, most of these are relatively small blocks that a construction worker must manually lift and put in place. Most require mortar and a considerable amount of labor to install. U.S. Pat. No. 6,796,098, which issued on Sep. 28, 2004, and U.S. Pat. No. 7,073,304, which issued on Jul. 11, 2006, disclose building blocks and a building block system that greatly simplifies construction of a wall using the blocks. These two patents were assigned to Stone Strong LLC of Lincoln, Nebraska, and are incorporated herein by reference. The blocks have a relatively large, finished surface. The blocks include one or more lift and alignment devices in the block that allow the block to be lifted using a suitable lifting apparatus, such as a crane, forklift, backhoe, etc. The blocks include one or more recessed portions in the bottom surface of the block positioned to receive the protruding lift and alignment device of a previously-laid block underneath, thereby helping to align the block with the previously-laid block. Some embodiments of the blocks include one or more voids that extend from the top surface to the bottom surface of the block, and that align with each other when the blocks are stacked into a wall, thereby allowing fill material to be placed in the voids to strengthen the wall.

BRIEF SUMMARY

According to the preferred embodiments, a system of blocks has a finished surface that provides an attractive appearance. The blocks are relatively large in size, allowing the quick construction of a wall, such as a retaining wall, using the blocks. The blocks may include one or more lift and alignment rings in the block that allow the block to be lifted using a suitable lifting apparatus, such as a crane, forklift, backhoe, etc. The blocks include one or more recessed portions in the bottom surface of the block positioned to receive the protruding lift and alignment device of a previously-laid block underneath, thereby helping to align the block with the previously-laid block.

The building blocks, system and methods disclosed herein provide improvements to the building blocks, system and methods disclosed in the two patents referenced in the Background Art second above. The front of the building block includes a finished front face that provides a decorative look, and the building block includes a tongue and a groove. In a first embodiment, one row of the blocks is placed adjacent to each other with the tongues and grooves facing up to form a first row with a finished front face that provides a decorative look. A second row of blocks identical to the first block can be placed inverted and opposite the first row of blocks so the tongues and grooves on the second row of blocks interlock with the tongues and grooves on the first row of blocks. The result is a wall that has two opposing finished faces with the blocks interlocked back-to-back. In a second embodiment, two types of blocks are provided, the first type having a finished front face and a second type having a thicker and heavier unfinished front face. In the second embodiment, one row of the blocks with the finished front face is placed adjacent to each other to form a first row with a finished front face. A second row of blocks with the unfinished front face are then positioned facing away from the first row of blocks so the tongues and grooves on each of each of the second blocks interlock with the grooves and tongues, respectively, on each of the first blocks. The result is a wall that has one finished face and an opposing unfinished face with the blocks interlocked back-to-back. The blocks can be made so a recess on the bottom of each block is offset from the lift and alignment rings on the top of the block so the blocks can be used to build a setback or battered wall, where each block is set back from the previous block. In the alternative, the blocks can be made so the recess on the bottom of each block aligns with the lift and alignment rings on the top of the block so the blocks can be used to build a vertical wall, where the face of each block aligns with the face of the previous block.

Building blocks include a tongue and groove on each block that allow the blocks to be placed in a way that interlocks the tongue and groove of one block with the corresponding groove and tongue, respectively, of another block facing the opposite direction, thereby interlocking the blocks back-to-back. In a first embodiment, the same building block that has a finished front face that provides a decorative look is used for both sides of the wall, resulting in a wall with opposed finished surfaces. In a second embodiment, a first plurality of blocks that have a finished front face that provide a decorative look are used for one side of the wall, while a second plurality of blocks that have a thicker and unfinished, non-decorative face are used for the other side of the wall, with the first and second plurality of blocks interlocking back-to-back via their respective tongues and grooves. Both types of blocks can be made using the same concrete form.

The foregoing and other features and advantages of the invention will be apparent from the following more particular description of preferred embodiments of the invention, as illustrated in the accompanying drawings.

BRIEF DESCRIPTION OF THE SEVERAL VIEWS OF THE DRAWING(S)

The preferred embodiments of the present invention will hereinafter be described in conjunction with the appended drawings, where like designations denote like elements, and:

DETAILED DESCRIPTION

Figure 1:
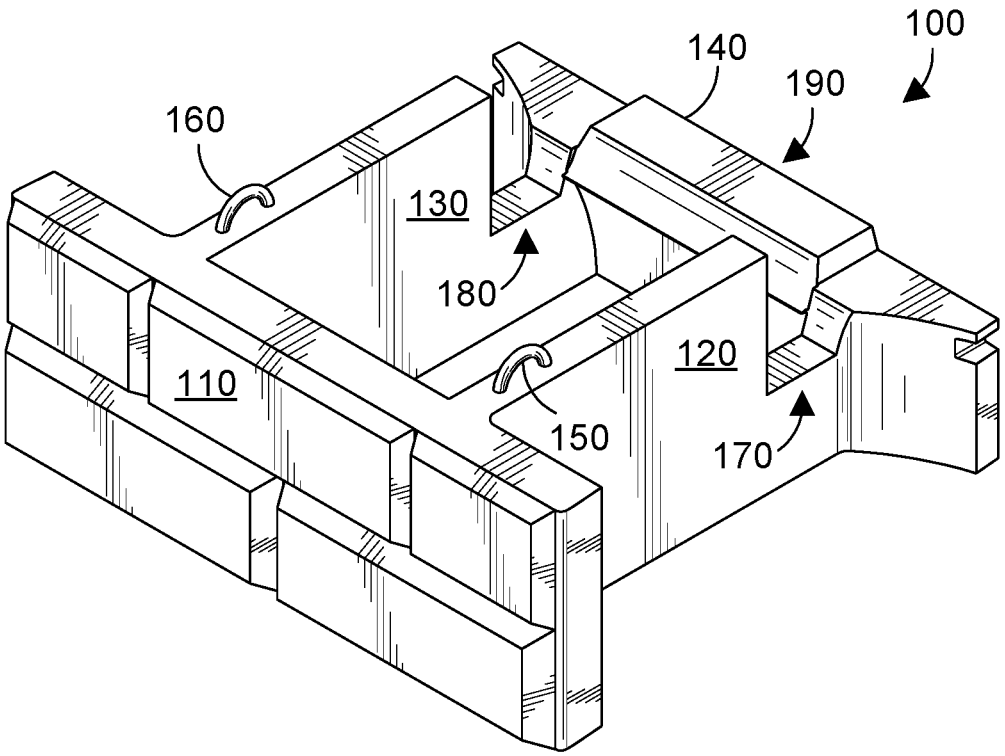
FIG. 1 is a perspective view of a first block that includes a finished front face that provides a decorative look.
Figure 2:
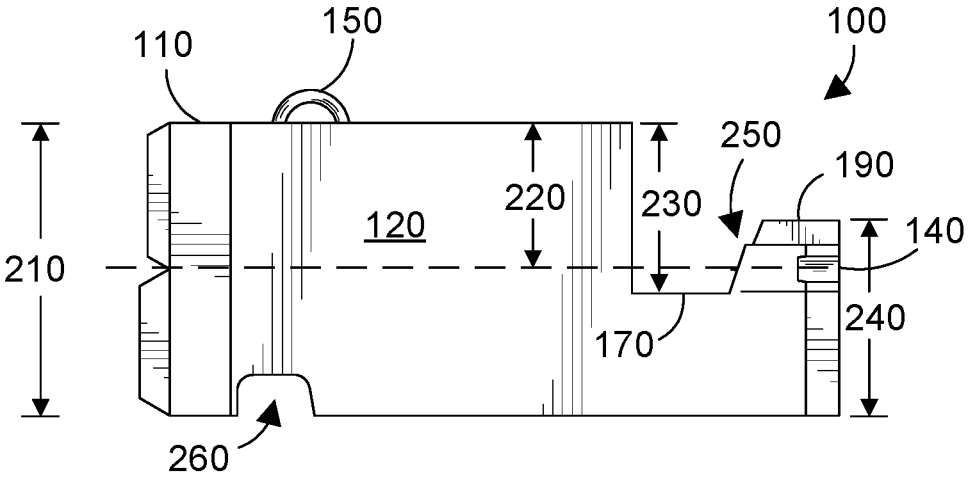
FIG. 2 is a side view of the block of FIG. 1.

Referring now to FIGS. 1-4, a first embodiment of a building block 100 includes a front 110, a right side 120, a left side 130, and a back 140. The front 110 preferably includes a finished, decorative front surface that resembles stone or provides other desired appearance, one example of which is shown in FIG. 1. Each side 120 and 130 preferably includes a corresponding lift and alignment ring 150 and 160, respectively. The lift and alignment rings 150 and 160 serve two functions, first to allow lifting and placing the block 100, and second to align a block being placed with a previously-placed block. The side 120 includes a groove 170, and, in similar configuration, side 130 includes a groove 180. Referring to FIG. 2, a horizontal dotted line is shown at a distance 220 from the top of the side 120 that represents approximately half of the total height 210 of the side 120. As shown more particularly in FIG. 2, groove 170 preferably has a depth 230 that extends downwardly from the top of side 120 to a point 240 greater than half the distance 220 between the top and the bottom of side 120. The back 140 of the block includes a tongue 190, shown best in FIG. 2, that extends upwardly from the bottom of the side 120 to a height greater than half the distance 220 between the bottom and the top. Side 130 includes a similar groove 180 shown in FIG. 1. The tongue and groove configuration allows blocks to be placed with the tongue of a first block engaging the groove of a second block, and the tongue of the second block engaging the groove of the first block, thereby interlocking the two blocks back-to-back.

In the preferred embodiments, an angled surface 250 connects the groove 170 to the tongue 190, as shown in FIG. 2. The angled surface 250 helps to slide a second block in place atop the first block so the tongues and grooves of two opposing blocks interlock with each other.

Figure 6:
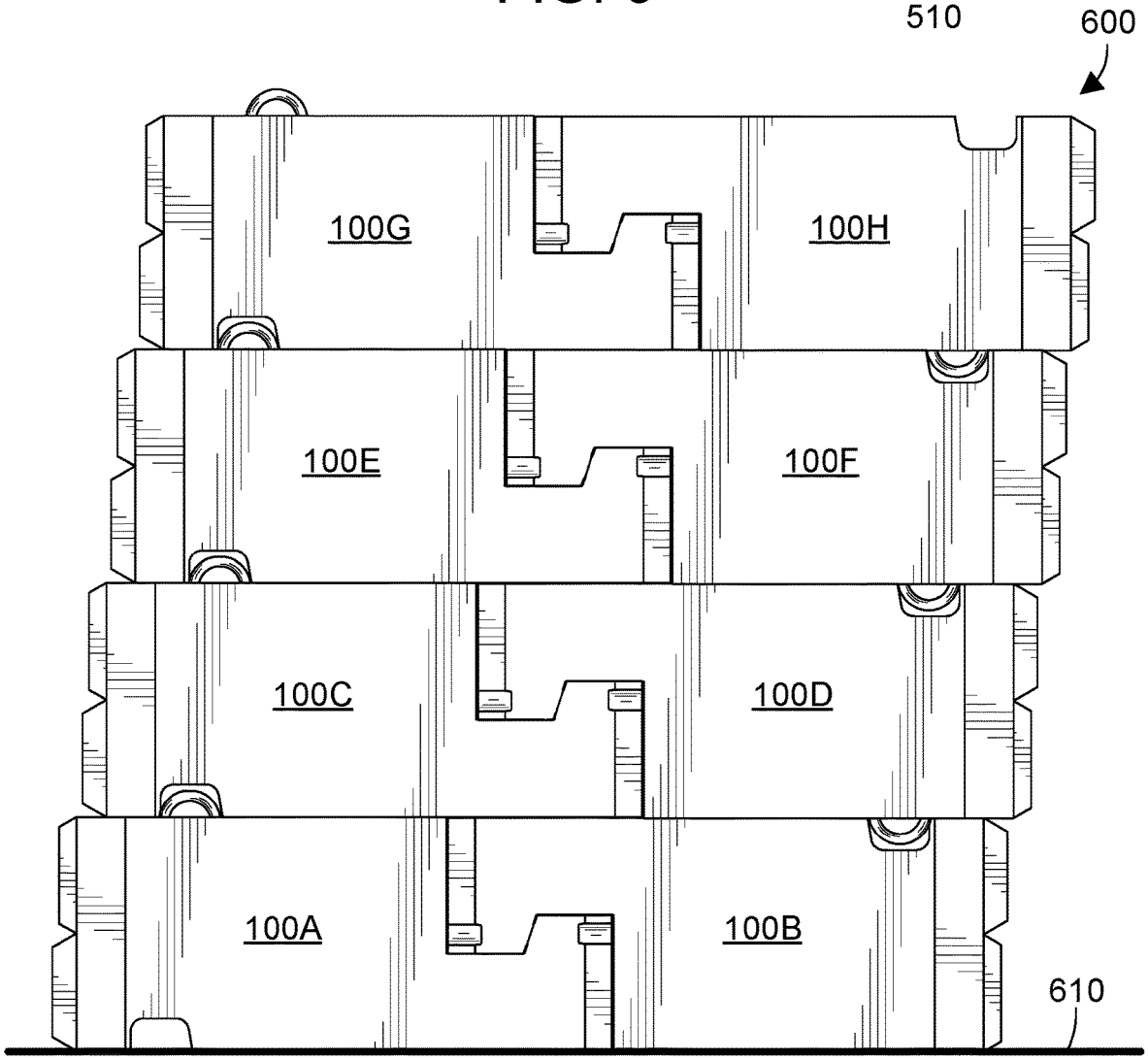
FIG. 6 is a cross-sectional view of a portion of a setback or battered wall built using eight of the interlocking blocks in FIGS. 1-4.

The bottom of each side preferably includes a recess 260 that is used to align the block 100 with a previously-placed block. In the configuration shown in FIG. 2, the recess 260 is offset from the position of the lift and alignment ring 150. This allows the block 100 to be used to build a setback or battered wall, as shown in FIG. 6.

Figure 3:
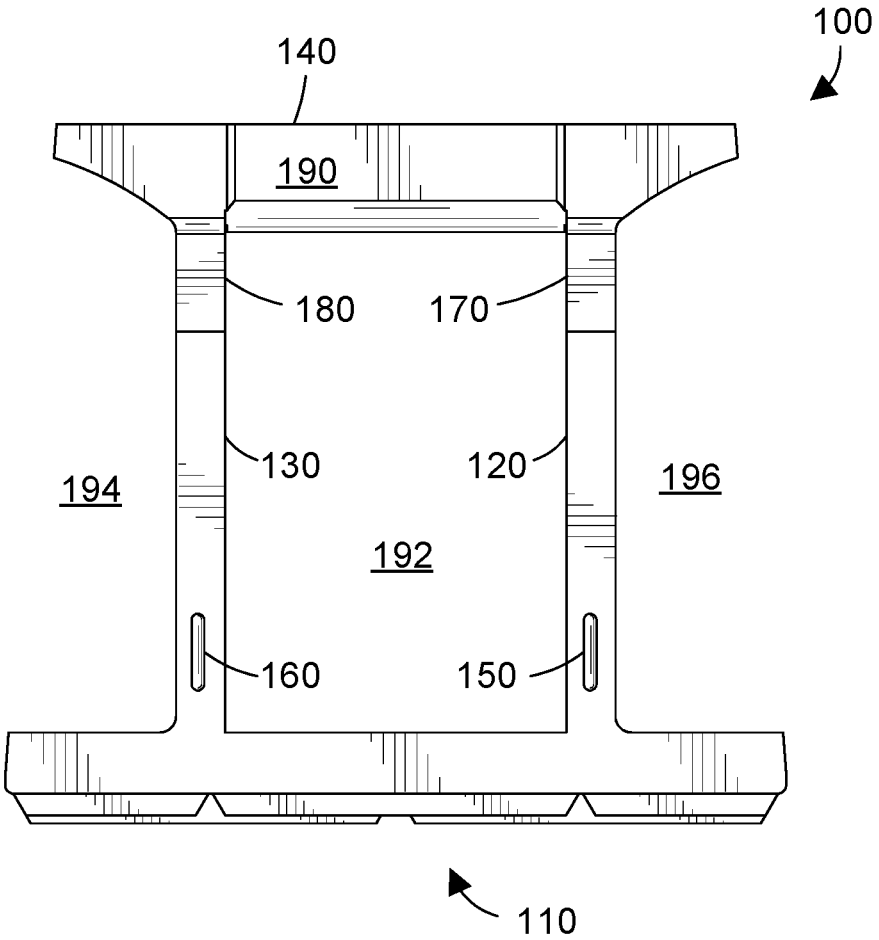
FIG. 3 is a top view of the block of FIGS. 1 and 2.
Figure 4:
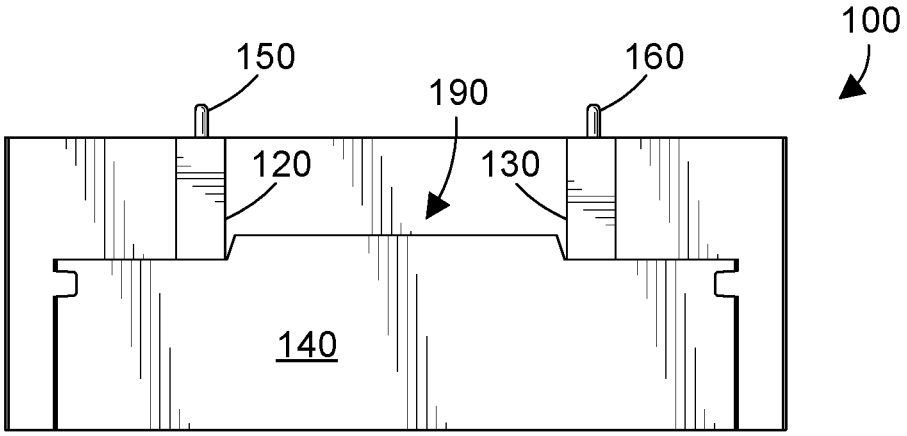
FIG. 4 is back view of the block in FIGS. 1-3.

Building block 100 preferably includes one or more voids that extend from the top surface to the bottom surface of the block. Examples of suitable voids are shown in FIG. 3 to include a fully enclosed void 192 and two partially enclosed voids 194 and 196. When blocks 100 are laid next to each other, partially enclosed voids 194 and 196 of adjacent blocks combine to form a void somewhat similar in size to void 192. These voids are designed to align with voids of other blocks when the blocks are stacked to form a wall. The voids may be filled with an appropriate filler material, such as recycled concrete, gravel, concrete, etc. Filling the voids with an appropriate filler material increases the shear strength of a wall built using the block 100. The preferred embodiments also extend to a block 100 that is solid, and thus has no voids.

Figure 5:
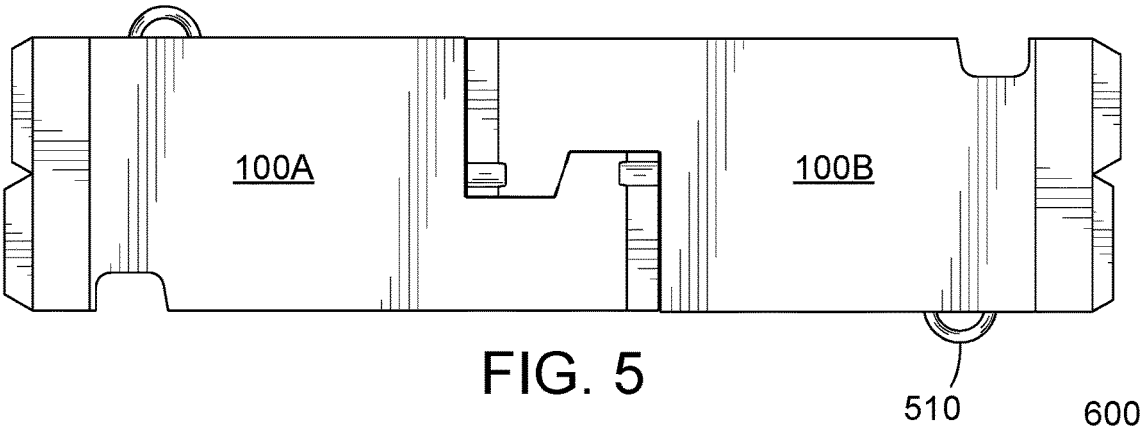
FIG. 5 is a side view showing how a first of the blocks in FIGS. 1-4 can be placed with the tongue and groove facing up, with a second of the blocks in FIGS. 1-4 being inverted with the tongue and groove facing down and interlocking with the groove and tongue, respectively, of the first block to provide two blocks that are interlocked back-to-back.

The interlocking of two substantially identical blocks back-to-back is shown in FIG. 5. A first block 100A represents one of the blocks 100 shown in FIGS. 1-4. A second block 100B represents another one of the blocks 100 shown in FIGS. 1-4, but inverted so the two blocks interlock as shown. Note the tongue (190 shown in FIG. 2) of block 100A engages the groove (170 shown in FIG. 2) of block 100B, while the tongue (190 shown in FIG. 2) of block 100B engages the groove (170 shown in FIG. 2) of block 100A.

With the block configuration shown in FIGS. 1-4, a setback or battered wall can be built. A first row of blocks 100A is placed on a suitable foundation 610, as shown in FIG. 6. Examples of a suitable foundation 610 include concrete and/or rock. Next, a row of blocks 100B is placed inverted with the tongues and grooves engaging the grooves and tongues, respectively, of the blocks 100A. Note the lift and alignment ring 510 of the inverted block 100B as shown in FIG. 5 can be removed with a cutter or grinder, or a space could be made in the foundation 610 so removing the lift and alignment ring 510 is not necessary. In the configuration shown in FIG. 6, the lift and alignment ring 510 shown in FIG. 5 has been removed. Once the row of blocks 100A and the row of blocks 100B have been placed, the result is a partial wall with two opposing finished faces, where the two rows of block are interlocked back-to-back. The next row of blocks 100C is then placed, with the recesses 260 aligning with the lift and alignment ring so the front face of blocks 100C is setback from the front face of blocks 100A, as shown in FIG. 6. The next row of blocks 100D is then placed inverted with the tongues and grooves engaging the grooves and tongues, respectively, of the blocks 100C. This process repeats for the row of blocks 100E, the row of blocks 100F, the row of blocks 100G, and the row of blocks 100H. The result is a wall 600 that has opposing finished surfaces that has been built from a single type of block, with one side right side up and the other side inverted, with the blocks on the two sides interlocking back-to-back as shown.

Figure 7:
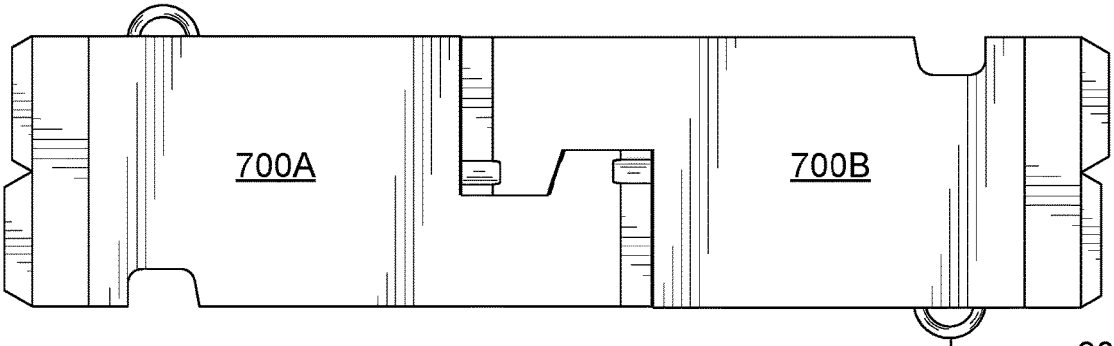
FIG. 7 is a side view of an alternative embodiment where the recess on the bottom of the block aligns with the lift and alignment rings on the top of the block.
Figure 8:
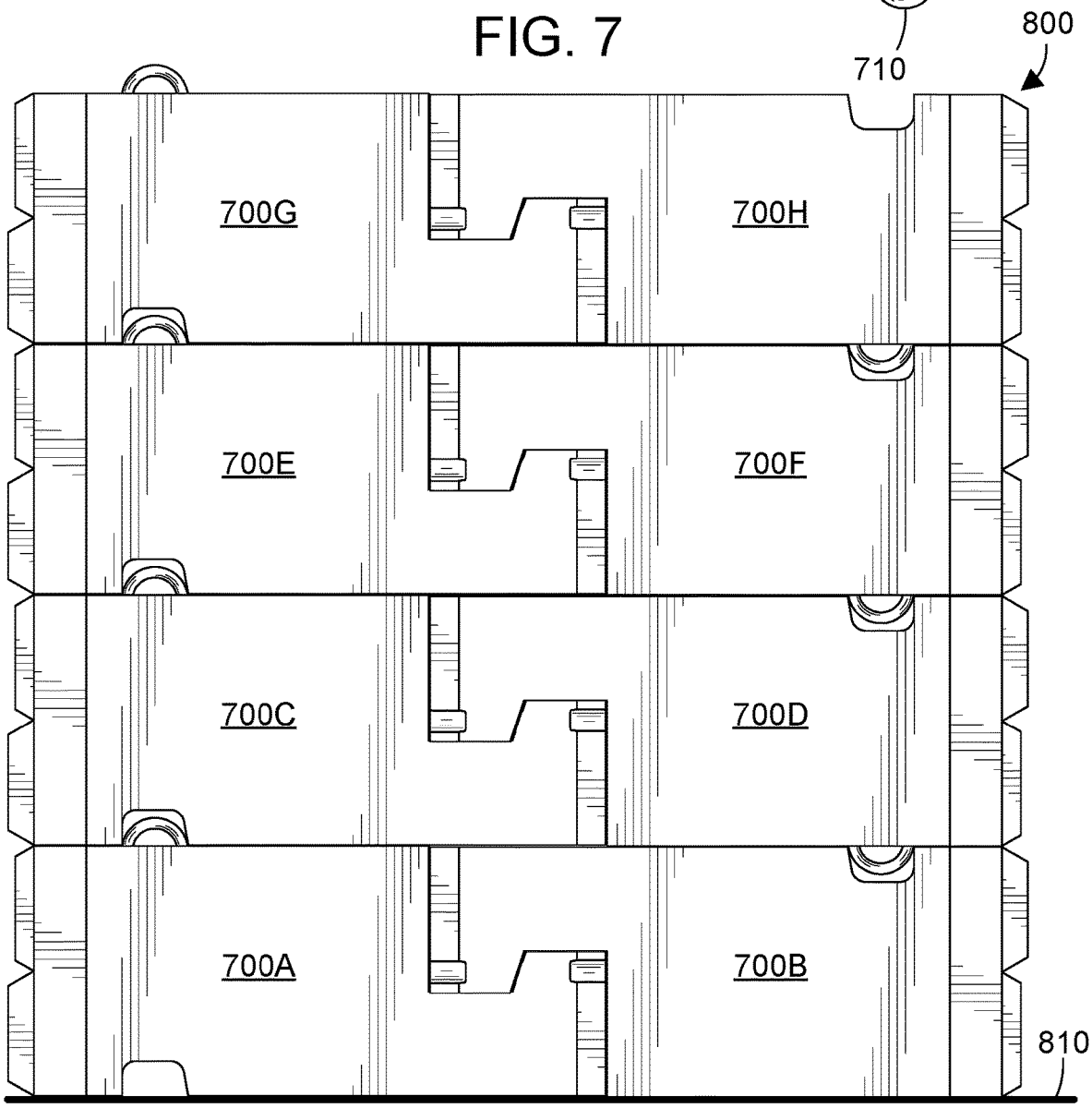
FIG. 8 is a cross-sectional view of a portion of a vertical wall built using eight of the interlocking blocks shown in FIG. 7.

In an alternative embodiment, the recess 260 in FIG. 2 could be positioned directly over the lift and alignment ring 150. Two such blocks 700A and 700B can be interlocked, as shown in FIG. 7. Blocks that have the recesses aligned with the lift and alignment rings can be used to build a vertical wall that has the faces of each row in the same plane as the faces on other rows on the same side of the wall, as shown in FIG. 8. A first row of blocks 700A is placed on the foundation 810. A second row of blocks 700B is placed inverted so the tongues and grooves interlock with the first blocks 700A as shown. In FIG. 8, the lift and alignment ring 710 shown in FIG. 7 has been removed. The next row of blocks 700C is placed. Because the bottom recess aligns with the lift and alignment ring, the front faces of blocks 700C will be in substantially the same plane as the front faces of blocks 700A. Once the row of blocks 700C has been placed, the row of blocks 700D is placed, followed by the row of blocks 700E, the row of blocks 700F, the row of blocks 700G, and the row of blocks 700H. The result is a wall 800 that has two finished surfaces opposite to and substantially parallel with each other, with each block interlocking with one or more other blocks back-to-back as shown.

While the blocks shown in FIGS. 6 and 8 are shown in cross-section for the purpose of illustration, one skilled in the art will appreciate the blocks of one row are preferably staggered with respect to a row of previously-placed blocks to provide a stronger wall. This applies not only to a row above but to the row behind as well. Thus, a first row of blocks 100A in FIG. 6 could be placed, and the second row of blocks 100B is placed staggered with respect to the first row of blocks 100A, and such that a tongue on a second block 100B engages a groove on two of the blocks 100A, and a tongue on the first block 100A engages a groove on two of the blocks 100B. This can be done, for example, by cutting one of the blocks 100B in half and starting at the end with a half block, which will cause blocks 100B to be staggered with respect to the edges of blocks 100A.

Figure 9:
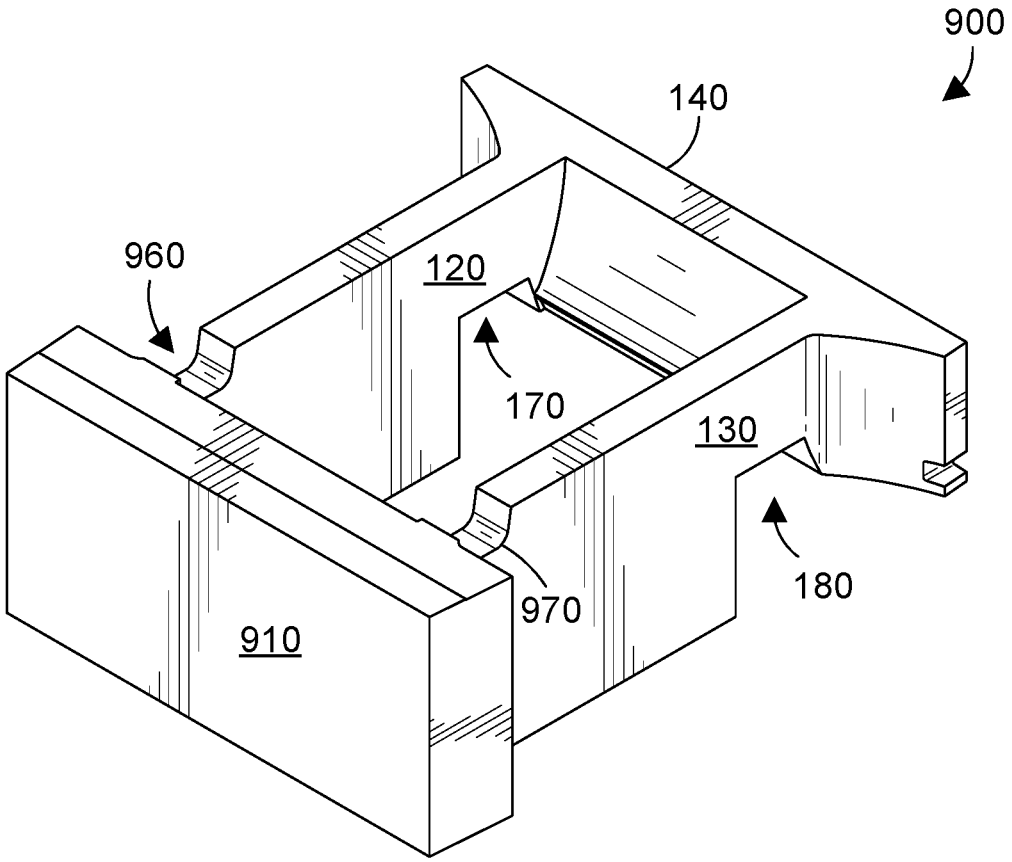
FIG. 9 is a perspective view of a block with an unfinished face that can be used in conjunction with the block with the finished face shown in FIGS. 1-4.
Figure 10:
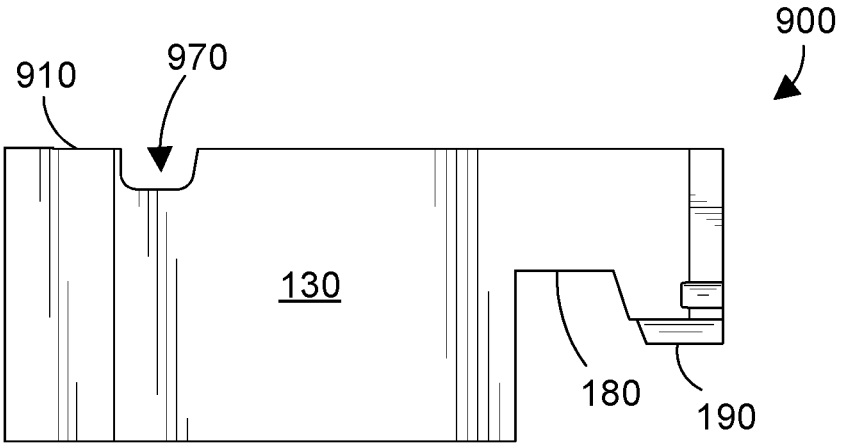
FIG. 10 is a side view of the back block shown in FIG. 9.

In a second embodiment, two different types of blocks can be interlocked. FIGS. 9 and 10 show a second type of block 900 that does not have or need a decorative front face because one side of the wall will have dirt or other suitable fill material backfilled against it. In the most preferred implementation, the block 900 has a very similar configuration as the block 100 shown in FIGS. 1-4, with the primary difference being the front 910 in FIG. 9 is thicker and heavier than the front 110 in FIGS. 1-3. The block 900 is shown in an orientation that is inverted compared to block 100 shown in FIG. 1. Block 900 includes sides 120 and 130 with their corresponding respective grooves 170 and 180. Side 130 includes a groove 180 and corresponding tongue 190 as shown in FIG. 10. Recess 960 is similar to recess 160 shown in FIG. 2, with a corresponding recess 970 in side 130.

The second type of block 900 shown in FIGS. 9 and 10 can be made using the same form used to make block 100 shown in FIGS. 1-4. The primary difference is the liner that provides the decorative surface of the front 110 is removed from the form, making the front 910 of block 900 an unfinished, non-decorative surface. Unfinished, non-decorative means the front 910 does not necessarily have any features that could be considered design features. Front 910 could thus be a plain concrete front. Design features are not needed because the front 910 will have dirt or other suitable material backfilled against it. The removal of the form liner that provides the decorative front face shown in FIG. 1 from the form causes the front 910 to be thicker and heavier than the front 110 in FIG. 1-3. The additional mass provided by a thicker front provides an advantage by providing a stronger block that allows building walls that are self-supported or that have a higher height than would be possible using the block 100 shown in FIGS. 1-4.

Figure 11:
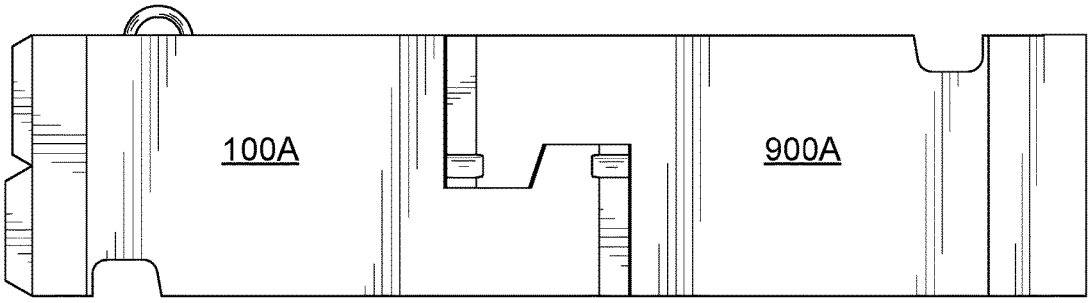
FIG. 11 is a side view showing how a first of the blocks in FIGS. 1-4 can be placed with the tongue and groove facing up, with a second of the blocks in FIGS. 9 and 10 being placed with the tongue and groove facing down and interlocking with the tongue and groove of the first block to provide two blocks that are interlocked back-to-back.
Figure 12:
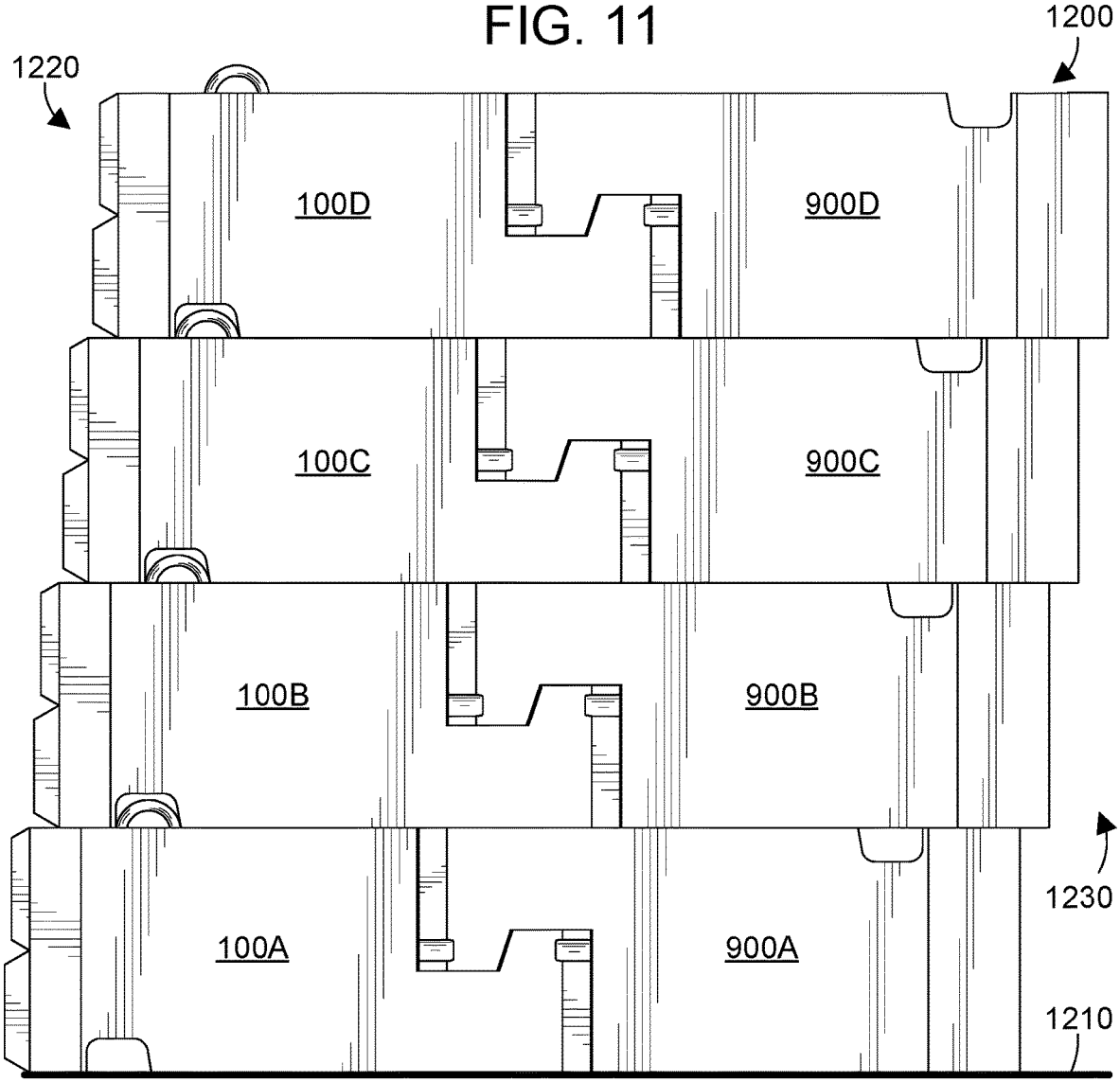
FIG. 12 is a cross-sectional view of a portion of a setback or battered wall built using four of the blocks in FIGS. 1-4 on the finished side of the wall 1220 and four of the blocks in FIGS. 9 and 10 on the opposite, unfinished side of the wall 1230.

FIG. 11 shows a first type of block 100A, which is one of the blocks 100 shown in FIGS. 1-4, interlocked back-to-back with the second type of block 900A, which is one of the blocks 900 shown in FIGS. 9 and 10. With the configuration shown in FIG. 11, a battered or setback wall can be built as shown in FIG. 12. A first row of blocks 100A is placed on a suitable foundation 1210. A row of blocks 900A is then placed, interlocking back-to-back with the first row of blocks 100A as shown. The row of blocks 100B is then placed, followed by the row of blocks 900B. The row of blocks 100C is then placed, followed by the row of blocks 900C. The row of blocks 100D is then placed, followed by the row of blocks 900D. The result is a wall 1200 that has one finished surface 1220 with a decorative look opposite to an unfinished surface 1230 against which dirt or other suitable material can be backfilled, with each block interlocking back-to-back with one or more other blocks as shown.

Figure 13:
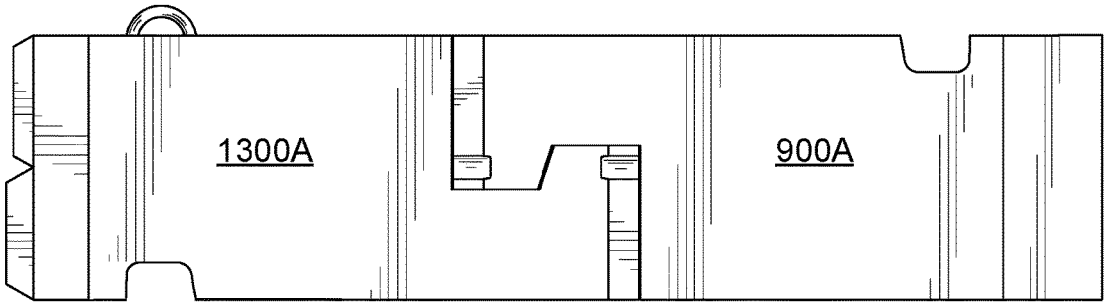
FIG. 13 is a side view of an alternative embodiment where the recess on the bottom of the block aligns with the lift and alignment rings on the top of the block.
Figure 14:
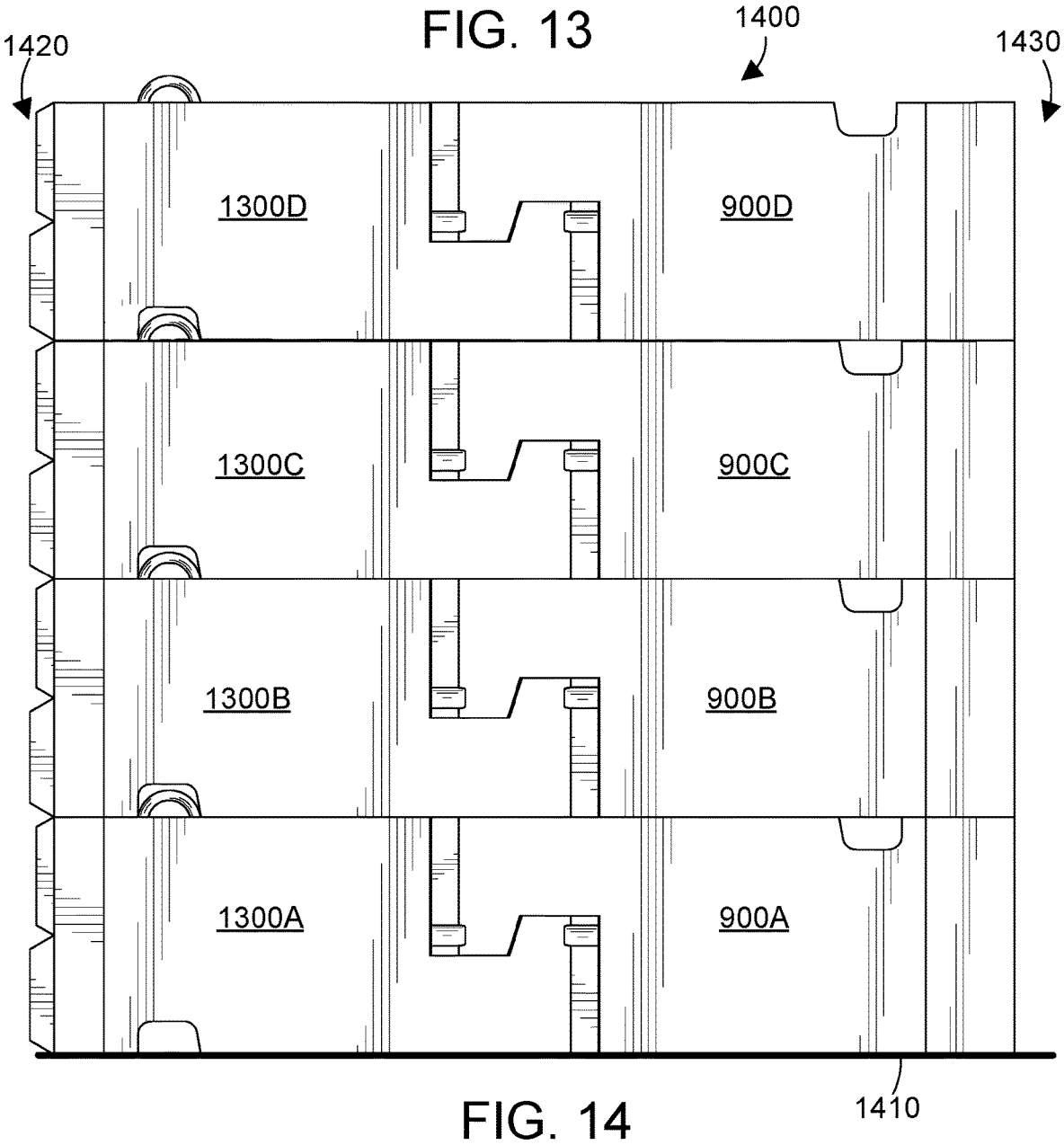
FIG. 14 is a cross-sectional view of a portion of a vertical wall built using four of the blocks with finished faces such as 1300A shown in FIG. 13 and four of the blocks with unfinished faces such as 900A shown in FIG. 13.

By positioning the lower recess of the blocks 100A to directly underlie the lift and alignment ring, as shown in block 1300A in FIG. 13, a vertical wall can be built, as shown in FIG. 14. A first row of blocks 1300A is placed on a suitable foundation 1410. A row of blocks 900A is then placed so they interlock back-to-back with the row of blocks 1300A as shown. A row of blocks 1300B is then placed, followed by the row of blocks 900B. A row of blocks 1300C is then placed, followed by the row of blocks 900C. A row of blocks 1300D is then placed, followed by the row of blocks 900D, resulting in a wall 1400 that has a first vertical side 1420 with a finished face that provides a decorative look and a second vertical side 1430 with an unfinished face against which dirt or other material can be backfilled.

Figure 15:
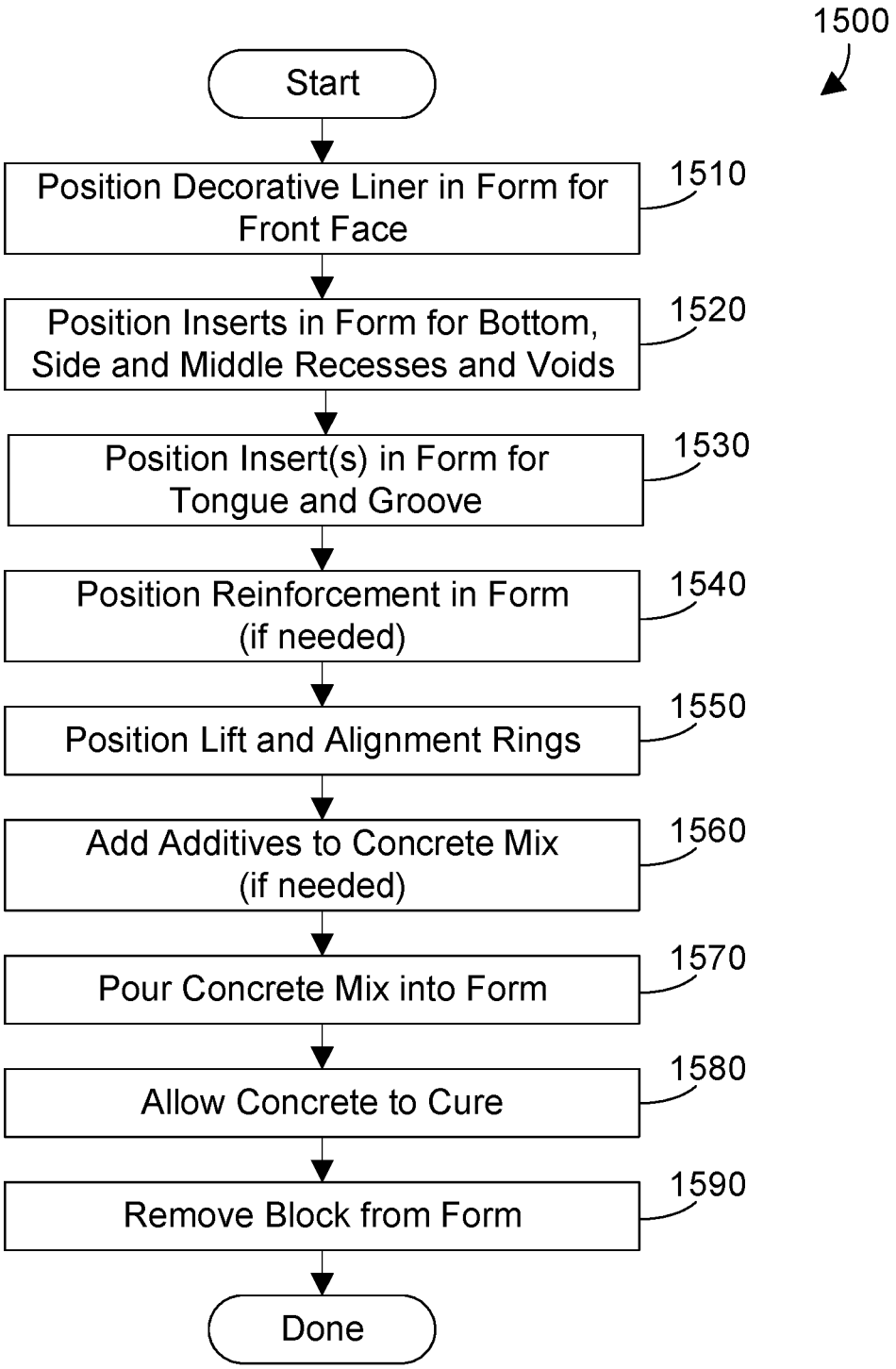
FIG. 15 is a method for manufacturing the block in FIGS. 1-4.

Referring to FIG. 15, a method 1500 is one suitable method for manufacturing the block 100 shown in FIGS. 1-4. Position a decorative liner in the form for the front face (step 1510). Position one or more inserts in the form for the bottom, side and middle recesses and voids (step 1520). Position one or more inserts in the form for the tongue and groove (step 1530). Note the positioning of the decorative liner in step 1510 and inserts in steps 1520 and 1530 need not necessarily be done for each block. For example, when pouring two identical blocks back-to-back, the decorative liner and previously-placed inserts can be used. The positioning of the liner in step 1510 and inserts in steps 1520 and 1530 can thus mean actually inserting the liner and inserts into the form, or merely verifying the liner and inserts are already in a correct position. Position reinforcement in the form, if needed (step 1540). Suitable reinforcement positioned in the form can include, for example, steel rebar and welded wire mesh. The lift and alignment rings are then positioned (step 1550) so the lift and alignment rings extend above the top of the block as shown in FIGS. 1-4. In one suitable implementation, the lift and alignment rings are placed through slots in the form and held in place with magnetic holders. Suitable additives can then be added to the concrete mix (step 1560). Suitable additives to the concrete mix can include, for example, steel fibers, fiberglass fibers, curing accelerators, plasticizers, chemicals, admixtures, etc. Pour the concrete mix into the form (step 1570). In the most preferred implementation, the concrete mix is poured to the top of the form in step 1570. Allow the concrete to cure (step 1580). In the most preferred embodiment, the concrete is allowed to cure to a minimum of 1,900 pounds per square inch (psi) (13 megapascal (MPa)). For a block of the dimensions in paragraph 0049, this minimum amount of cure can be achieved by leaving the block in the form for 3-4 hours when concrete curing accelerators are added to the concrete mix, thus allowing two pours per business day. This minimum amount of cure can also be achieved without adding concrete accelerators to the concrete mix by leaving the block in the form for 8-10 hours. Once sufficient time has passed to assure the concrete has cured to a minimum of 1,900 psi (13 MPa), the block is removed from the form (step 1590). Method 1500 is then done.

In the most preferred implementation, the building blocks disclosed herein comprise concrete that comprises a mixture of sand, gravel, water, and cement in a mix rated at a minimum of 4,000 pounds per square inch (28 MPa).

Figure 16:
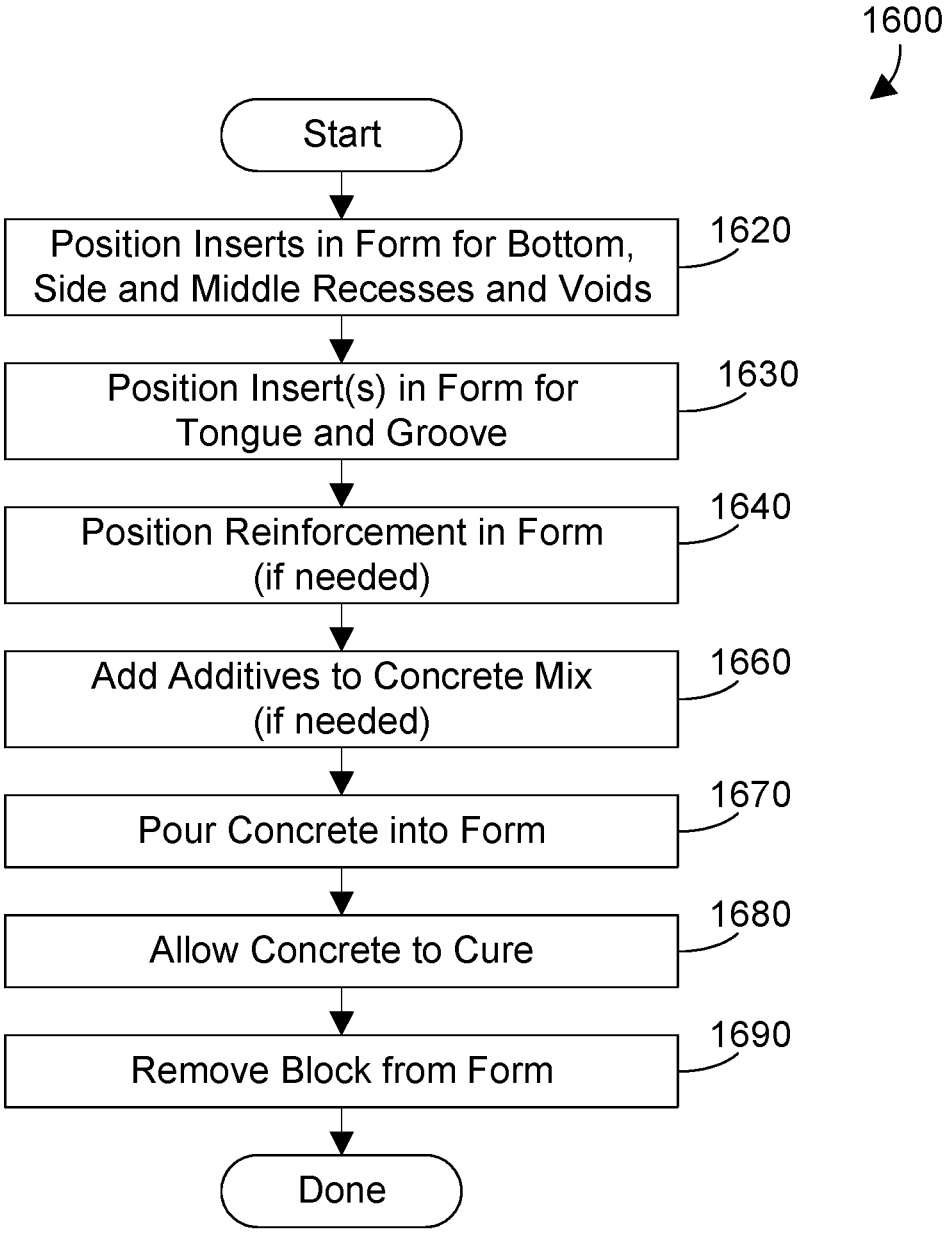
FIG. 16 is a method for manufacturing the block in FIGS. 9 and 10 using the same form and form inserts used to manufacture the block in FIGS. 1-4.

Referring to FIG. 16, a method 1600 is one suitable method for manufacturing the block 900 shown in FIGS. 9 and 10. Position one or more inserts in the form for the bottom, side and middle recesses and voids (step 1620). Position one or more inserts in the form for the tongue and groove (step 1630). Position reinforcement in the form, if needed (step 1640). Add additives to the concrete mix, if needed (step 1660). Pour the concrete mix into the form (step 1670). Allow the concrete to cure (step 1680). Remove the block from the form (step 1690). Method 1600 is then done.

In one specific embodiment, method 1500 in FIG. 15 is different from method 1600 in FIG. 16 only by method 1500 in FIG. 15 having the additional steps of positioning the decorative liner in the form for the front face in step 1510 and adding the lift and alignment rings in step 1550. Method 1600 does not use the decorative liner in the form for the front face, and does not use lift and alignment rings. This change allows the exact same form and inserts to be used to fabricate block 100 in FIGS. 1-4 and block 900 in FIGS. 9 and 10, with the only differences, in the most preferred embodiment, being that steps 1510 and 1550 are not performed in method 1600 in FIG. 16. The other steps 1620, 1630, 1640, 1660, 1670, 1680 and 1690 in method 1600 in FIG. 16 most preferably correspond to the steps 1520, 1530, 1540, 1560, 1570, 1580 and 1590 in FIG. 15. The inserting or not of the decorative liner into the form and the addition or not of the lift and alignment rings can thus be the difference between forming a block 100 or forming a block 900. Note the block 900 made using method 1600 in FIG. 16 can include one or more lift hooks or loops in one of its voids that allow lifting the block 900 but do not interfere with stacking the block 900.

There are many variations to method 1500 in FIG. 15 and method 1600 in FIG. 16 that are within the scope of the disclosure and claims herein. For example, the form can include vibrator mounts to vibrate the form to eliminate unwanted voids in the concrete mix. The concrete mix could include plasticizers and/or chemicals to make the concrete self-consolidating, which does not require vibration to eliminate voids. These and other variations are within the scope of the disclosure and claims herein.

Figure 17:
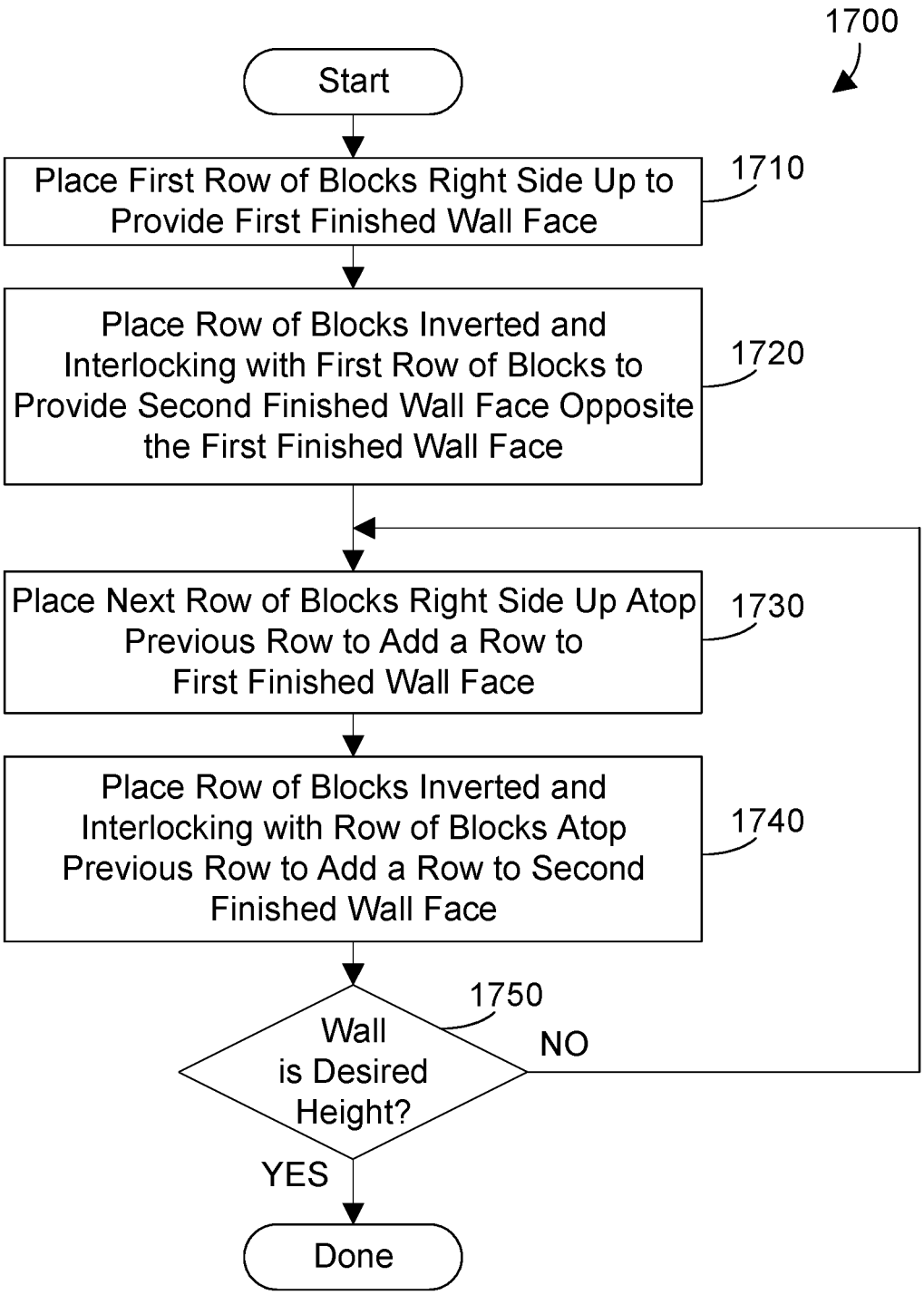
FIG. 17 is a method for building a wall using the blocks in FIGS. 1-4.

A method 1700 for building a wall using a single type of block is shown in FIG. 17. Place a first row of blocks right side up to provide a first row of finished wall face that provides a decorative look (step 1710). A row of blocks is then placed inverted and interlocking with the first row of blocks to provide a first row of second finished wall face opposite the first finished wall face (step 1720). The next row of blocks is placed right side up atop the previous row of blocks placed in step 1710 to add a row to the first finished wall face (step 1730). A row of blocks is then placed inverted and atop the row of blocks placed in step 1720 to interlock back-to-back with the blocks placed in step 1730 and to add a row to the second finished wall face (step 1740). When the wall is not yet the desired height (step 1750=NO), method 1700 loops back to repeat steps 1730 and 1740 until the wall is the desired height (step 1750=YES), at which point method 1700 is done.

A building block wall system in accordance with the first embodiment uses a single type of block, such as block 100 shown in FIGS. 1-4, with the block being right side up on one side of the wall and inverted on the opposite side of the wall, with the tongue and groove of one block engaging the groove and tongue, respectively, of the other block, as shown in FIGS. 6 and 8. A building block wall system in accordance with the second embodiment uses two types of blocks, the first type such as block 100 shown in FIGS. 1-4, and the second type such as block 900 shown in FIGS. 9 and 10.

Figure 18:
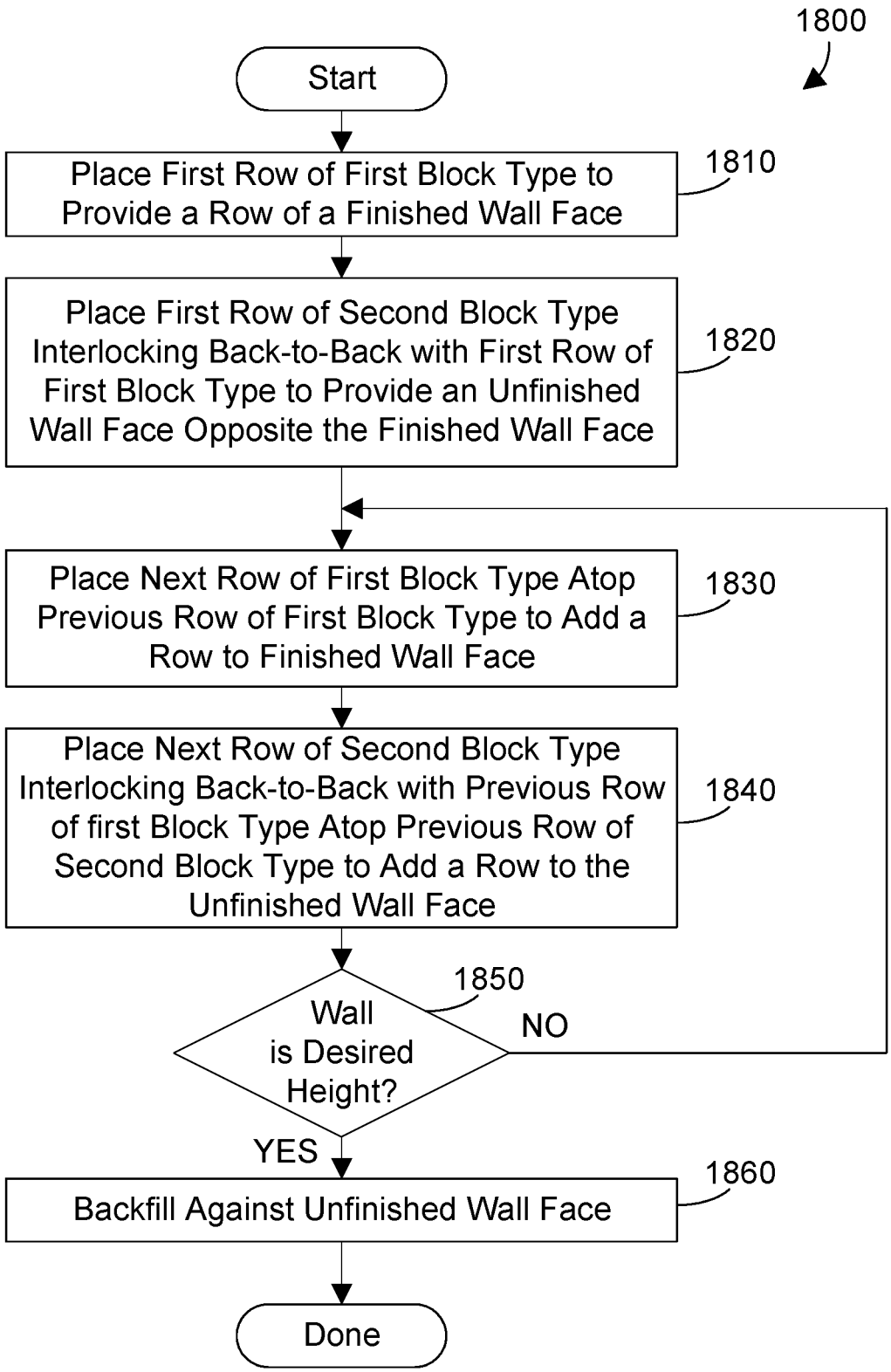
FIG. 18 is a method for building a wall using the blocks in FIGS. 1-4 for a finished face of the wall and the blocks in FIGS. 9 and 10 for an unfinished face of the wall.

A method 1800 for building a wall using two types of blocks is shown in FIG. 18. Place a first row of blocks of the first block type (such as block 100 in FIGS. 1-4) to provide a row of finished wall face that provides a decorative look (step 1810). A row of blocks of the second block type (such as block 900 in FIGS. 9 and 10) is then placed interlocking back-to-back with the first row of blocks to provide a row of unfinished wall face opposite the finished wall face (step 1820). The next row of blocks of the first block type is then placed atop the previous row of the first block type placed in step 1810 to add a row to the finished wall face (step 1830). A row of blocks of the second block type is then placed atop the row of blocks of the second block type placed in step 1820 to add a row to the unfinished wall face (step 1840). When the wall is not yet the desired height (step 1850=NO), method 1800 loops back to repeat steps 1830 and 1840 until the wall is the desired height (step 1850=YES). Backfill is then added against the unfinished wall face (step 1860), and method 1800 is done. Note that backfilling can be done row by row instead of waiting until the wall is the desired height as shown in FIG. 18.

In the most preferred embodiments, the blocks discussed herein are relatively large, allowing the building of a wall with the blocks to progress quickly using equipment such as a crane or backhoe. For example, in one suitable implementation, the blocks are 36 inches (91 cm) tall, 96 inches (244 cm) wide, and 86 inches (218 cm) deep.

The units herein are expressed in both English and metric units. The preferred embodiments are implemented in English units, and any variation between the stated English units and their metric equivalents is due to rounding errors, with the English units being the more correct measurement of the two.

The disclosure and claims herein support a method for making a building block comprising: positioning a plurality of inserts in a concrete form for forming the building block, wherein at least one of the plurality of inserts causes the creation of a tongue and groove on the building block that allows interlocking two building blocks together back-to-back, wherein the two building blocks are both made with the concrete form; pouring a concrete mix into the form; allowing the concrete mix to cure; and removing the block from the form.

The disclosure and claims herein further support a method for making a building block comprising: positioning a decorative liner in the form to provide a front of the building block that has a finished front face that provides a decorative look; positioning a plurality of inserts in a concrete form for forming the building block, wherein at least one of the plurality of inserts causes the creation of a tongue and groove on the building block that allows interlocking two building blocks together back-to-back, wherein the two building blocks are both made with the concrete form; positioning at least one lift and alignment ring in the form; pouring a concrete mix into the form; allowing the concrete mix to cure; and removing the block from the form.

The disclosure and claims herein additionally support a method for building a wall comprising: (A) providing a first plurality of building blocks, each of the first plurality of building blocks comprising: a first front; first and second sides extending from the first front, each of the first and second sides comprising a first top and a first bottom, wherein each of the first and second sides comprises a first groove that extends downwardly from the first top to a point greater than half the distance between the first top and the first bottom; a first back coupled to the first and second sides, the first back comprising a tongue that extends upwardly from the first bottom to a point greater than half the distance between the first bottom and the first top; (B) providing a second plurality of building blocks, each of the second plurality of building blocks comprising: a second front; third and fourth sides extending from the second front, each of the third and fourth sides comprising a second top and a second bottom, wherein each of the third and fourth sides comprises a second groove that extends downwardly from the second top to a point greater than half the distance between the second top and the second bottom; a second back coupled to the third and fourth sides, the second back comprising a second tongue that extends upwardly from the second bottom to a point greater than half the distance between the second bottom and the second top; (C) placing a first row of the first plurality of building blocks; (D) placing a first row of the second plurality of building blocks oriented such that the first tongue engages the second groove and the second tongue engages the first groove, thereby interlocking the first and second plurality of building blocks back-to-back to provide a wall with the first front on a first side of the wall and the second front on a second opposing side of the wall.

While the invention has been particularly shown and described with reference to preferred embodiments thereof, it will be understood by those skilled in the art that various changes in form and details may be made therein without departing from the spirit and scope of the invention. For example, while FIGS. 6 and 8 show a wall with two similar finished faces using the same block, it is equally within the scope of the disclosure and claims herein to provide two different finished faces. Similarly, while FIG. 14 shows a wall with one finished face and one unfinished faces, the disclosure and claims herein extent to providing a wall with two unfinished faces. While the block herein is described as being used for retaining walls, it is equally within the scope of the preferred embodiments to use the building block for other purposes, such as building construction.

The invention claimed is:

1. A method for making a building block comprising:

positioning a plurality of inserts in a concrete form for forming the building block, wherein at least one of the plurality of inserts causes the creation of a tongue and a groove on the building block that allows interlocking two building blocks together back-to-back, wherein the two building blocks are both made with the concrete form, wherein each of the two building blocks comprises:

a front having a top and a bottom;

first and second sides extending from the front, each of the first and second sides comprising a top that is substantially coplanar with the top of the front and a bottom that is substantially coplanar with the bottom of the front, wherein each of the first and second sides comprises the groove that extends downwardly from the top; and a back coupled to the first and second sides, the back comprising the tongue that extends upwardly from the bottom;

pouring a concrete mix into the form;

allowing the concrete mix to cure; and removing the block from the form.

2. The method of claim 1 further comprising positioning at least one metal reinforcement in the form before pouring the concrete mix into the form.

3. The method of claim 1 further comprising adding at least one reinforcement additive to the concrete mix before pouring the concrete mix into the form.

4. A method for making a building block comprising:

positioning a decorative liner in a form to provide a front of the building block that has a finished front face that provides a decorative look;

positioning a plurality of inserts in a concrete form for forming the building block, wherein at least one of the plurality of inserts causes the creation of a tongue and groove on the building block that allows interlocking two building blocks together back-to-back, wherein the two building blocks are both made with the concrete form, wherein each of the two building blocks comprises:

a front having a top and a bottom;

first and second sides extending from the front, each of the first and second sides comprising a top that is substantially coplanar with the top of the front and a bottom that is substantially coplanar with the bottom of the front, wherein each of the first and second sides comprises the groove that extends downwardly from the top; and a back coupled to the first and second sides, the back comprising the tongue that extends upwardly from the bottom;

positioning at least one lift and alignment ring in the form;

pouring a concrete mix into the form;

allowing the concrete mix to cure; and removing the block from the form.

5. The method of claim 4 wherein the concrete mix comprises a mixture of sand, gravel, water, and cement in a mix rated at a minimum of 4,000 pounds per square inch (28 MPa).

6. The method of claim 4 wherein at least one of the plurality of inserts defines a recess on a lower portion of the building block to align with the at least one lift and alignment ring of a previously-placed building block.

7. The method of claim 4 wherein the two building blocks are substantially identical.

8. The method of claim 4 wherein at least one of the plurality of inserts create a recess on a lower portion of the first and second sides positioned offset from the at least one lift and alignment ring.

9. The method of claim 4 wherein at least one of the plurality of inserts create a recess on a lower portion of the first and second sides positioned directly under the at least one lift and alignment ring.

10. The method of claim 4 further comprising positioning metal reinforcement into the form before pouring the concrete mix into the form.

11. The method of claim 4 further comprising adding at least one additive to the concrete mix before pouring the concrete mix into the form.

12. The method of claim 4 wherein the at least one additive comprises steel fibers.

13. The method of claim 4 wherein the at least one additive comprises fiberglass fibers.

14. The method of claim 4 wherein the at least one additive comprises at least one curing accelerator.

15. A method for building a wall comprising:

(a) providing a first plurality of building blocks, each of the first plurality of building blocks comprising:

a first front having a top and a bottom;

first and second sides extending from the first front, each of the first and second sides comprising a first top that is substantially coplanar with the top of the first front and a first bottom that is substantially coplanar with the bottom of the first front, wherein each of the first and second sides comprises a first groove that extends downwardly from the first top;

a first back coupled to the first and second sides, the first back comprising a first tongue that extends upwardly from the first bottom;

(b) providing a second plurality of building blocks, each of the second plurality of building blocks comprising:

a second front having a top and a bottom;

third and fourth sides extending from the second front, each of the third and fourth sides comprising a second top that is substantially coplanar with the top of the second front and a second bottom that is substantially coplanar with the bottom of the second front, wherein each of the third and fourth sides comprises a second groove that extends downwardly from the second top to a point greater than half the distance between the second top and the second bottom;

a second back coupled to the third and fourth sides, the second back comprising a second tongue that extends upwardly from the second bottom to a point greater than half the distance between the second bottom and the second top;

(c) placing a first row of the first plurality of building blocks;

(d) placing a first row of the second plurality of building blocks oriented such that the first tongue engages the second groove and the second tongue engages the first groove, thereby interlocking the first and second plurality of building blocks back-to-back to provide a wall with the first front on a first side of the wall and the second front on a second opposing side of the wall.

16. The method of claim 15 wherein the first plurality of building blocks and the second plurality of building blocks are substantially identical.

17. The method of claim 15 wherein the first plurality of building blocks each has a finished front face that provides a decorative look.

18. The method of claim 17 wherein the second plurality of building blocks each has an unfinished front face thicker than the finished front face.

19. The method of claim 15 wherein the first plurality of building blocks each comprises at least one lift and alignment ring extending from a top of at least one of the first and second sides.

20. The method of claim 19 wherein the first plurality of building blocks each comprises a recess on a lower portion of the first and second sides positioned to align with the at least one lift and alignment ring of a previously-placed building block.

21. The method of claim 15 wherein when the first tongue of the first block engages the second groove of the second block and the second tongue of the second block engages the first groove of the first block, the bottom of the first side of the first block and the bottom of the second side of the first block are coplanar with the top of the first side of the second block and the top of the second side of the second block.

22. The method of claim 15 wherein when the first tongue of the first block engages the second groove of the second block and the second tongue of the second block engages the first groove of the first block, the top of the first side of the first block and the top of the second side of the first block are coplanar with the bottom of the first side of the second block and the bottom of the second side of the second block.

* * * * *